US005137431A

United States Patent [19]

Kiyoshi et al.

[11] Patent Number: 5,137,431

[45] Date of Patent: Aug. 11, 1992

[54] LUBRICATING MECHANISM AND METHOD FOR A PISTON ASSEMBLY OF A SLANT PLATE TYPE COMPRESSOR

[75] Inventors: Terauchu Kiyoshi; Shigemi Shimizu, both of Isesaki, Japan

[73] Assignee: Sanden Corporation, Gunma, Japan

[21] Appl. No.: 557,740

[22] Filed: Jul. 26, 1990

[30] Foreign Application Priority Data

Jul. 26, 1989 [JP] Japan ..... 1-86846[U]

[51] Int. Cl.[5] ..... F04B 1/12; F04B 27/08

[52] U.S. Cl. ..... 417/269

[58] Field of Search ..... 417/269; 92/154, 160, 92/162 R, 247, 182, 183; 184/6.17

[56] References Cited

U.S. PATENT DOCUMENTS 4,784,045 11/1988 Terauchi ..... 417/269

4,981,419 1/1991 Kayukawa et al. ..... 417/269

*Primary Examiner*—Richard A. Bertsch

*Assistant Examiner*—Alfred Basichas

*Attorney, Agent, or Firm*—Banner, Birch, McKie & Beckett

[57] ABSTRACT

A slant plate type compressor having a lubricating mechanism for a piston assembly includes a housing having a cylinder block provided with a plurality of cylinders and a crank chamber adjacent the cylinder block. A piston slides within each cylinder and is reciprocated by a wobble plate driven by a cam rotor mounted on a drive shaft. Each piston is connected to the outer periphery of the wobble plate by a connecting rod. The piston has at least one piston ring disposed on its outer peripheral surface. The piston and connecting rod are connected by a ball-socket connection. During the compression stroke, the lubricating mechanism, which has a conduit formed in the piston, supplies lubricating oil from the piston chamber and the pressure reduced refrigerant gas to a gap created within the ball-socket connection.

26 Claims, 3 Drawing Sheets

LUBRICATING MECHANISM AND METHOD FOR A PISTON ASSEMBLY OF A SLANT PLATE TYPE COMPRESSOR

BACKGROUND OF THE INVENTION

1. Technical Field

The present invention generally relates to a refrigerant compressor, and more particularly, to a slant plate type piston compressor, such as a wobble plate type piston compressor having a lubricating mechanism for a piston assembly for use in an automotive air conditioning system.

2. Description of the Prior Art

A wobble plate type compressor disclosed in U.S. Pat. No. 4,594,055 includes a piston assembly having a piston and connecting rod which connects a wobble plate and the piston. The piston is provided with a spherical concavity at its bottom side for receiving a ball portion formed at one end of the connecting rod. After receiving the ball portion, a bottom end peripheral portion of the spherical concavity is radially inwardly bent by using a caulking apparatus to firmly grasp the ball portion; however, the ball portion is allowed to slidably move along an inner surface of the spherical concavity. Therefore, a slight gap is created between the inner surface of the spherical concavity and the outer surface of the ball portion. The above-mentioned connection is generally called a ball-socket connection.

Accordingly, it is required to supply lubricating oil to the gap to smoothly move the ball portion along the inner surface of the spherical concavity without abnormal wearing of the ball portion. In Japanese Utility Model Application Publication No. 01-71178, a mechanism for supplying lubricating oil to the gap from the cylinder chamber during the compression stroke is disclosed. However, in this Japanese '178 application, during the compression stroke, lubricating oil is supplied to the gap from the piston chamber together with high pressure refrigerant gas. Smooth movement of the ball portion within the spherical concavity is prevented by the undesirable high pressure of the refrigerant gas. Consequently, abnormal wearing of the inner surface of the spherical concavity and the outer surface of the ball portion is experienced.

Futhermore, because of environmental concerns dictating the use of R134a as the refrigerant of the compressor, the above-mentioned defect becomes worse due to the decreased lubricating ability of R134a compared with conventional CFC refrigerants.

SUMMARY OF THE INVENTION

Accordingly, it is an object of the present invention to provide a slant plate type compressor having an improved lubricating mechanism for a ball-socket connection of a piston assembly.

According to one embodiment of the invention a piston is provided with two annular grooves. Disposed in the annular grooves are piston rings. A first piston ring is exposed to the piston chamber pressure while a second piston ring is exposed to the crank chamber pressure. An intermediate space is developed between the two piston rings, the cylinder wall, and the piston. The piston is provided with a radial conduit with one end opening in the intermediate space, and the other end opening to the ball and socket connection.

As the piston is reciprocated in the cylinder, it is desirable to supply lubricating oil to the ball and socket joint; however, the high pressure refrigerant gas entering the conduit decreases the amount of lubricating oil received in the conduit. Accordingly, it is necessary to regulate the pressure of the high pressure refrigerant gas entering the conduit so that the supply of lubricating oil to the ball and socket joint is not detrimentally impeded. The instant invention accomplishes these goals by providing a throttling device between the piston chamber and the ball and socket joint. More specifically, during the compression stroke of the cylinder, high pressure refrigerant gas and lubricating oil are throttled through a small gap between the first piston ring and the annular groove. With the reduced pressure refrigerant gas and lubricating oil now in the intermediate space, the radial conduit conducts both lubricating oil and throttled refrigerant gas to the ball and socket joint for lubrication. Because the refrigerant gas has had its pressure reduced across the throttling device, sufficient lubricating oil reliably lubricates the ball and socket joint. Further throttling is realized between the gap in the ball and socket to the crank chamber. Incidentally, still further throttling is also accomplished between the second piston ring and the second annular groove into the relatively low pressure crank chamber.

According to another aspect of this invention the conduit has one end open to the ball and socket joint and another end open to the annular groove associated with the first piston ring. The conduit has a small diameter portion formed in its end opening to the ball and socket joint. During the compression stroke of the piston, the high pressure refrigerant gas and lubricating oil enter the conduit, and are throttled through the small diameter portion. Accordingly, sufficient lubricating oil reliably lubricates the ball and socket joint, because the refrigerant gas had its pressure reduced to an acceptable level across the small diameter throttling device. Once again, further throttling is realized between the gap in the ball and socket to the crank chamber. Incidentally, further residual throttling is realized between the piston rings and annular grooves as the refrigerant gas in the intermediate chamber seeks the lower pressure crank chamber.

DETAILED DESCRIPTION OF THE PREFERRED EMBODIMENTS

Figure 1:
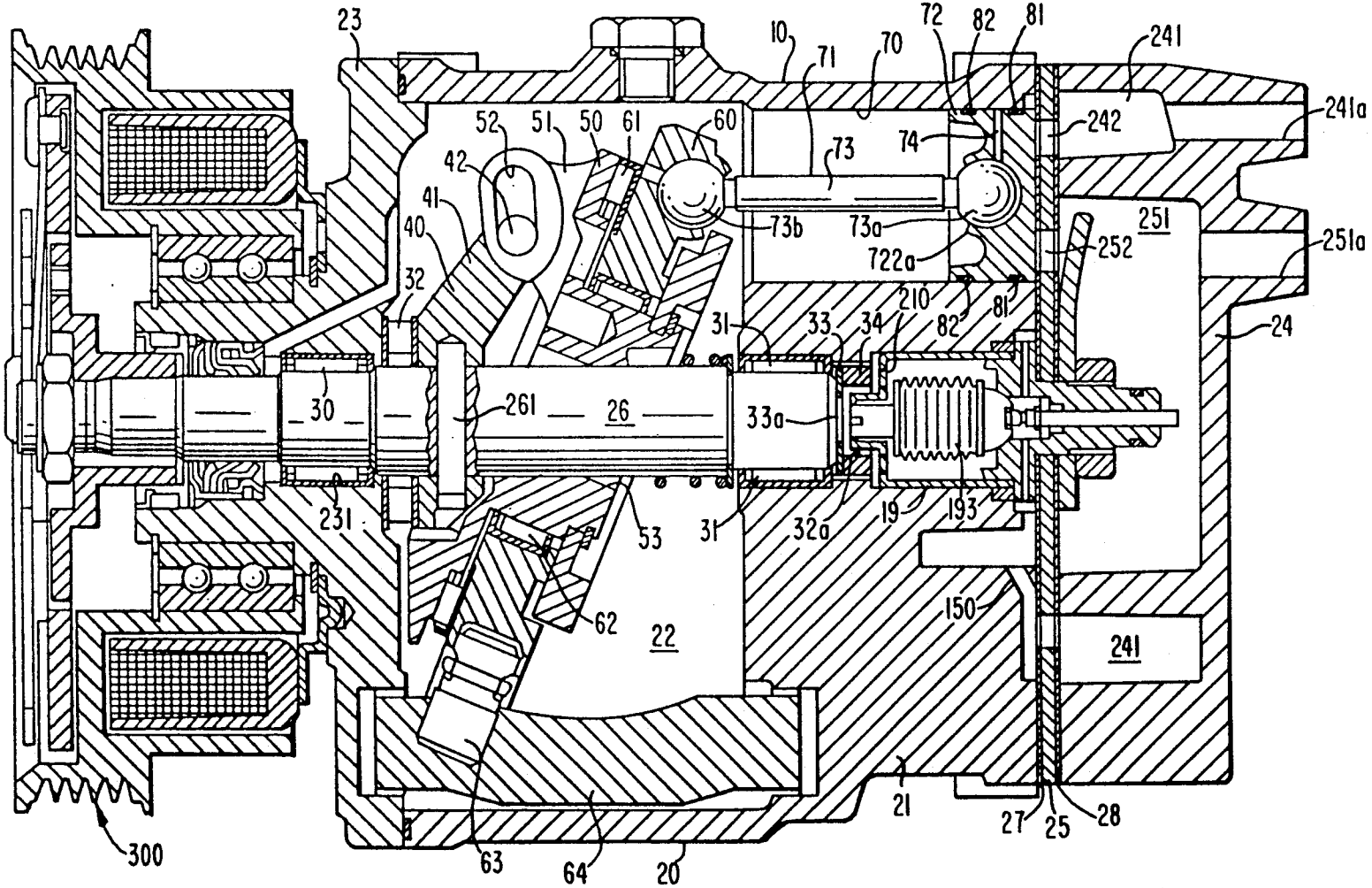
FIG. 1 is a vertical longitudinal sectional view of a wobble plate type refrigerant compressor according to a first embodiment of this invention.

With reference to FIG. 1, the construction of a slant plate type compressor, specifically a wobble plate type refrigerant compressor 10 in accordance with a first embodiment of the present invention is shown. Compressor 10 includes cylindrical housing assembly 20 including cylinder block 21, crank chamber 22 formed between cylinder block 21 and front end plate 23, and rear end plate 24 attached to the other end of cylinder block 21. Front end plate 23 is mounted on cylinder block 21 forward (to the left side in FIG. 1) of crank chamber 22 by a plurality of bolts (not shown). Rear end plate 24 is mounted on cylinder block 21 at its opposite end by a plurality of bolts (not shown). Valve plate 25 is located between rear end plate 24 and cylinder block 21. Opening 231 is centrally formed in front end plate 23 for supporting drive shaft 26 by bearing 30 disposed in the opening. The inner end portion of drive shaft 26 is rotatably supported by bearing 31 disposed within central bore 210 of cylinder block 21. Bore 210 extends to a rearward end surface of cylinder block 21 wherein there is disposed valve control mechanism 19 as disclosed in Japanese Patent Application Publication No. 01-142276.

Cam rotor 40 is fixed on drive shaft 26 by pin member 261 and rotates with shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening 53 through which passes drive shaft 26. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to the longitudinal axis of drive shaft 26.

Wobble plate 60 is nutatably mounted on slant plate 50 through bearings 61 and 62. Fork-shaped slider 63 is attached to the outer peripheral end of wobble plate 60 and is slidably mounted about sliding rail 64 held between front end plate 23 and cylinder block 21. Fork-shaped slider 63 prevents rotation of wobble plate 60, and wobble plate 60 nutates along rail 64 when cam rotor 40 rotates. Cylinder block 21 includes a plurality of peripherally located cylinder chambers 70 in which pistons 72 reciprocate. Each piston 72 is connected to wobble plate 60 by a corresponding connecting rod 73. Each piston 72 and connecting rod 73 substantially compose piston assembly 71 as discussed below.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinder chambers 70. Suction ports 242 and discharge ports 252 are provided with suitable reed valves as described in U.S. Pat. No. 4,011,029 to Shimizu.

Suction chamber 241 includes inlet portion 241*a* which is connected to an evaporator of the external cooling circuit (not shown). Discharge chamber 251 is provided with outlet portion 251*a* connected to a condenser of the cooling circuit (not shown). Gaskets 27 and 28 are located between cylinder block 21 and the inner surface of valve plate 25, and the outer surface of valve plate 25 and rear end plate 24, respectively, to seal the mating surfaces of cylinder block 21, valve plate 25 and rear end plate 24.

Disk-shaped adjusting screw member 34 is disposed in a central region of bore 210 located between the inner end portion of drive shaft 26 and valve control mechanism 19. Disk-shaped adjusting screw member 32 is screwed into bore 210 to be in contact with the inner end surface of drive shaft 26 through washer 33, and adjusts an axial position of drive shaft 26 by tightening and loosing thereof. Disk-shaped adjusting screw member 32 and washer 33 include central holes 32*a* and 33*a*, respectively, in order to provide communication between crank chamber 22 and suction chamber 241 via valve control mechanism 19 and passageway 150, as substantially disclosed in above-mentioned Japanese '276 Patent Application Publication. The opening and closing of passageway 150 is controlled by the contracting and expanding of bellows 193 of valve control mechanism 19 in response to crank chamber pressure.

During operation of compressor 10, drive shaft 26 is rotated by the engine of the vehicle through electromagnetic clutch 300. Cam rotor 40 is rotated with drive shaft 26, rotating slant plate 50 as well, which causes wobble plate 60 to nutate. Nutational motion of wobble plate 60 reciprocates pistons 71 in their respective cylinders 70. As pistons 71 are reciprocated, refrigerant gas, which is introduced into suction chamber 241 through inlet portion 241*a*, flows into each cylinder 70 through suction ports 242, and is then compressed. The compressed refrigerant gas is discharged to discharge chamber 251 from each cylinder 70 through discharge ports 252, and therefrom into the cooling circuit through outlet portion 251*a*.

The capacity of compressor 10 is adjusted to maintain a constant pressure in suction chamber 241 in response to change in the heat load of the evaporator or change in the rotating speed of the compressor. The capacity of the compressor is adjusted by changing the angle of the slant plate which is dependent upon the crank chamber pressure or more precisely, the difference between the crank chamber and the suction chamber pressures. During operation of the compressor, the pressure of the crank chamber increases due to blow-by gas flowing past pistons 72 as they are reciprocated in cylinders 70. As the crank chamber pressure increases relative to the suction pressure, the slant angle of the slant plate and thus of the wobble plate decreases, decreasing the capacity of the compressor. A decrease in the crank chamber pressure relative to the suction pressure causes an increase in the angle of the slant plate and the wobble plate, and thus an increase in the capacity of the compressor. The crank chamber pressure is decreased whenever it is linked to the suction chamber 241 due to the contraction of bellows 193 and the corresponding opening of passageway 150. Valve control mechanism 19 maintains a constant pressure at the outlet of the evaporator during capacity control of the compressor.

Figure 2:
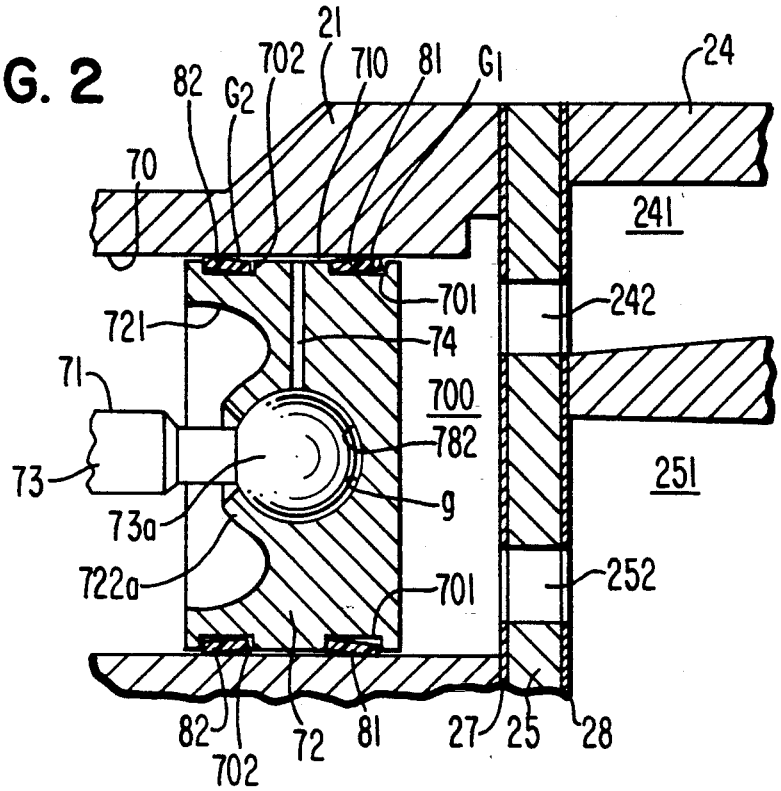
FIG. 2 is an enlarged partial sectional view of a piston assembly shown in FIG. 1.

With reference to FIG. 2, piston assembly 71 includes connecting rod 73 which includes a pair of ball portions 73*a* and 73*b* (FIG. 1) formed at both ends thereof and cylindrically-shaped piston 72 which is connected to ball portion 73*a* formed at the rear (to the right in FIGS. 1 and 2) end of connecting rod 73 in a manner described below. Piston 72 includes depressed portion 721 formed at the bottom (to the left in FIGS. 1 and 2) thereof. A central region of depressed portion 721 is further depressed so as to define spherical concavity 722 which receives ball portion 73*a* therewithin. After receiving ball portion 73*a*, the bottom end peripheral portion 722*a* of spherical concavity 722 is radially inwardly bent by using a caulking apparatus (not shown) in order to firmly grasp ball portion 73*a*, but ball portion 73*a* is allowed to slidably move along an inner surface of spherical concavity 722. Therefore, a slight gap "g" is created between the inner surface of spherical concavity 722 and the outer surface of ball portion 73*a*. The above-mentioned manner of connection between the ball portion of the spherical concavity is generally called a ball-socket connection. The outer peripheral end of wobble plate 60 and ball portion 73*b* formed at the other end of connecting rod 73 are connected by the ball-socket connection as well.

As disclosed in U.S. Pat. No. 4,594,055, piston 72 is provided with two annular grooves 701 and 702 at its outer peripheral surface near top and bottom portions thereof. Conically shaped piston rings 81 and 82, which are formed of resin and of identical construction, fit into grooves 701 and 702, respectively, to seal the outer peripheral surface of piston 72 and an inner surface of cylinder 70. Conduit 74 is radially formed in piston 72. One end of conduit 74 is open to the outer peripheral surface of piston 72 located between grooves 701 and 702, and the other end is open to the inner surface of spherical concavity 722.

It should be understood that although only one piston assembly is shown in FIG. 1, there are plural, for example, five such sockets arranged peripherally around the wobble plate to respectively receive the five pistons employed in the disclosed embodiment.

Figure 3:
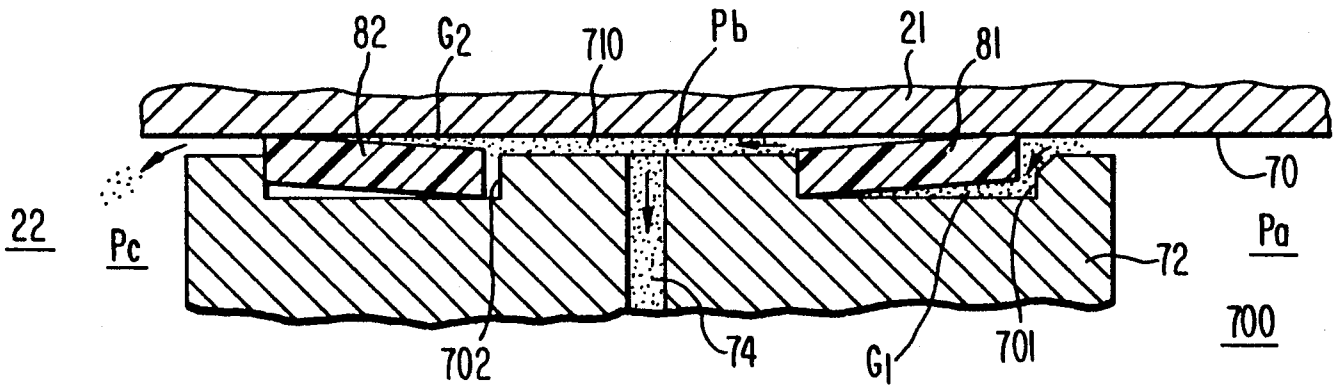
FIG. 3 is an enlarged partial sectional view of the piston assembly shown in FIG. 2. In the drawing, the flow of the refrigerant gas and lubricating oil is illustrated.

The effect of the piston assembly of the present invention is as follows. With reference to FIG. 3, during the compression stroke, a small part of the compressed refrigerant gas in piston chamber 700 which is defined by piston 72 and the inner peripheral surface of cylinder 70 flows into gap "G1" created between the inner peripheral surface of piston ring 81 and the bottom surface of groove 701, and radially outwardly pushes piston ring 81 by its pressure force. Thereby, the refrigerant gas in gap "G1" further flows into intermediate space 710 defined by piston 72, cylinder 70 and piston rings 81, 82 with a pressure drop due to the throttling effect of gap "G1". Furthermore, a small part of the refrigerant gas in intermediate space 710 radially inwardly pushes piston ring 82 by its pressure force, and flows into crank chamber 22 with a further pressure drop due to the throttling effect of gap "G2" created between the outer peripheral surface of piston ring 82 and the inner surface of cylinder 70. Still furthermore, the majority of the refrigerant gas in intermediate space 710 flows into gap "g" created between the inner surface of spherical concavity 722 and the outer surface of ball portion 73*a* through conduit 74, and then the refrigerant gas in gap "g" flows to crank chamber 22 with a further pressure drop due to the throttling effect of gap "g". As a result, during the compression stroke of the compressor, pressure Pb in intermediate space 710 is given by $Pa > Pb > Pc$, where, Pa is the pressure in piston chamber 700 and Pc is the pressure in crank chamber 22.

Accordingly, during the compression stroke, the lubricating oil accumulated at an adjacent outer peripheral surface near the top portion of piston 72 flows to intermediate space 710 through gap "G1" together with the pressure reduced refrigerant gas. The majority of the lubricating oil in space 710 is conducted into gap "g" through conduit 74 due to the pressure difference between Pb (the pressure in intermediate space 710) and Pc (the pressure in crank chamber 22). The remaining lubricating oil in space 710 is conducted to crank chamber 22 due to the pressure difference between Pb and Pc. Thereby, ball portion 73*a* of connecting rod 73 can smoothly move along the inner surface of spherical concavity 722 without abnormal wearing of the inner surface of spherical concavity 722 and the outer surface of ball portion 73*a* even though R134a is employed as the refrigerant of the compressor.

Figure 4:
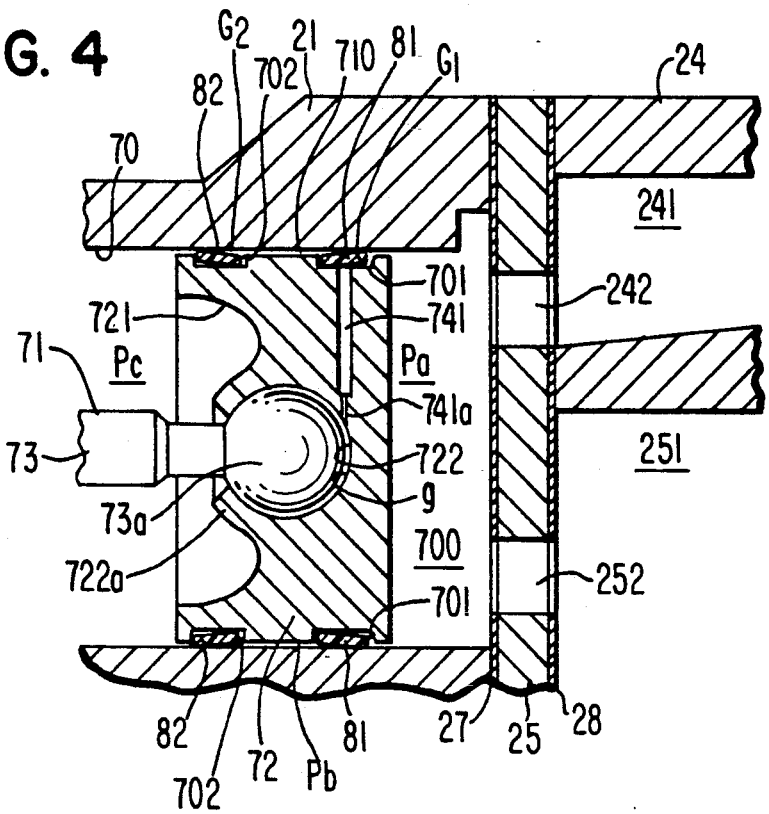
FIG. 4 is a view similar to FIG. 2 illustrating a second embodiment of this invention.

FIG. 4 shows a certain portion of a wobble plate type refrigerant compressor including a piston assembly in accordance with a second embodiment of this invention in which the same numerals are used to denote the same elements shown in FIG. 2.

In the second embodiment, conduit 741 having a small diameter portion 741*a* at its one end is radially formed in piston 72. One end of small diameter portion 741*a* is open to the inner surface of spherical concavity 722, and the opposite end of conduit 741 is open to the center of the bottom surface of annular groove 701. Therefore, during the compression stroke, the majority of the refrigerant gas in gap "G1" flows into gap "g" through conduit 741 with a pressure drop due to the throttling effect of small diameter portion 741*a*. Then the refrigerant gas in gap "g" flows to crank chamber 22 with a further pressure drop due to the throttling effect of gap "g". The remaining refrigerant in gap "G1" flows to crank chamber 22 via intermediate space 710 and gap "G2" with a pressure drop due to the throttling effect of gaps "G1" and "G2".

Accordingly, during the compression stroke, the majority of the lubricating oil accumulated at the adjacent outer peripheral surface near the top portion of piston 72 is conducted into gap "g" via gap "G1" and conduit 741 due to the pressure difference between Pa (the pressure in piston chamber 700) and Pc (the pressure in crank chamber 22). Thereby, ball portion 73*a* of connecting rod 73 can smoothly move along the inner surface of spherical concavity 722 without abnormal wearing of the inner surface of spherical concavity 722 and the outer surface of ball portion 73*a* even through R134a is employed as the refrigerant of the compressor.

In the above-mentioned two embodiments, the present invention is applied to a slant plate type compressor with a capacity control mechanism; however, of course, the present invention can be also applied to a fixed capacity slant plate type compressor.

This invention has been described in connection with the preferred embodiments. These embodiments, however, are merely for example only and the invention is not restricted thereto. It will be understood by those skilled in the art that other variations and modifications can easily be made within the scope of this invention as defined by the claims.

We claim:

1. In a refrigerant compressor including a compressor housing, said compressor housing including a cylinder block, a front end plate disposed on one end of said cylinder block, a rear end plate disposed on an opposite end of said cylinder block, said rear end plate having a discharge chamber and a suction chamber formed therein, said cylinder block having a plurality of cylinders formed therein, a crank chamber disposed forwardly of said plurality of cylinders and enclosed within said cylinder block by said front end plate, a piston slidably fitted within each of said cylinders, a piston chamber defined by each of said pistons and said cylinders, said pistons reciprocated by a drive mechanism, said drive mechanism including a drive shaft extending through an opening in said front end plate and rotatably supported therein, a drive rotor fixedly attached to and rotatable with said drive shaft, a slant plate attached to said drive rotor and disposed around said drive shaft and a wobble plate disposed on said slant plate and linked to said pistons through a connecting rod to reciprocate said pistons in said cylinders, said connecting rod including a ball portion formed at its one end, said piston including a spherical concavity formed at its bottom end to firmly receive said ball portion of said connecting rod while allowing said ball portion of said connecting rod to slidably move along an inner surface of said spherical concavity, at least one annular groove being provided on the outer peripheral surface of each of said pistons, at least one piston ring disposed within said at least one annular groove, said at least one annular groove having an outer diameter larger than the outer diameter of said piston at normal temperatures, the improvement comprising:

means for throttling said piston chamber pressure, and at least one conduit formed in each of said pistons, one end of said conduit being open to the outer peripheral surface of each of said pistons, said one end of said conduit disposed on the crank chamber side with respect to said at least one groove, and the other end of said conduit opening into said spherical concavity, said at least one conduit delivering said throttled piston chamber pressure to said spherical concavity.

2. The compressor according to claim 1 wherein said at least one piston ring is exposed to the pressure in said piston chamber.

3. The compressor according to claim 2 further comprising a second piston ring and a second annular groove.

4. The compressor according to claim 3 wherein said second piston ring is exposed to the pressure in said crank chamber.

5. The compressor according to claim 3 further comprising an intermediate space defined between said at least one piston ring and said second piston ring, said at least one conduit opening into said intermediate space.

6. The compressor according to claim 5 wherein said throttling means comprises a gap between said at least one piston ring and said at least one annular groove.

7. The compressor according to claim 5 further comprising means for throttling the intermediate space pressure into said crank chamber.

8. The compressor according to claim 7 wherein said throttling means comprises a gap between said spherical concavity and said ball portion.

9. The compressor according to claim 7 wherein said throttling means comprises a gap between said second piston ring and said second annular groove.

10. In a refrigerant compressor including a compressor housing, said compressor housing including a cylinder block, a front end plate disposed on one end of said cylinder block, a rear end plate disposed on an opposite end of said cylinder block, said rear end plate having a discharge chamber and a suction chamber formed therein, said cylinder block having a plurality of cylinders formed therein, a crank chamber disposed forwardly of said plurality of cylinders and enclosed within said cylinder block by said front end plate, a piston slidably fitted within each of said cylinders, a piston chamber defined by each of said pistons and said cylinders, said pistons reciprocated by a drive mechanism, said drive mechanism including a drive shaft extending through an opening in said front end plate and rotatably supported therein, a drive rotor fixedly attached to and rotatable with said drive shaft, a slant plate attached to said drive rotor and disposed around said drive shaft and a wobble plate disposed on said slant plate and linked to said pistons through a connecting rod to reciprocate said pistons in said cylinders, said connecting rod including a ball portion formed at its one end, said piston including a spherical concavity formed at its bottom end to firmly receive said ball portion of said connecting rod while allowing said ball portion of said connecting rod to slidably move along an inner surface of said spherical concavity, at least one annular groove being provided on the outer peripheral surface of each of said pistons, at least one piston ring disposed within said at least one annular groove having an outer diameter larger than the outer diameter of said piston at normal temperatures, the improvement comprising:

at least one conduit forming a fluid communication path between a bottom surface of said at least one annular groove and the inner surface of said spherical concavity, and a throttling means formed in said at least one conduit.

11. The compressor according to claim 10 wherein said at least one piston ring is exposed to the pressure in said piston chamber.

12. The compressor according to claim 11 further comprising a second piston ring and a second annular groove.

13. The compressor according to claim 12 wherein said second piston ring is exposed to the pressure in said crank chamber.

14. The compressor according to claim 12 further comprising an intermediate space defined between said at least one piston ring and said second piston ring.

15. The compressor according to claim 14 further comprising means for throttling the piston chamber pressure into said intermediate space.

16. The compressor according to claim 15 wherein said throttling means comprises a gap between said at least one piston ring and said at least one annular groove.

17. The compressor according to claim 14 further comprising means for throttling the intermediate space pressure into said crank chamber.

18. The compressor according to claim 17 wherein said throttling means comprises a gap between said second piston ring and said second annular groove.

19. In a refrigerant compressor including a compressor housing, said compressor housing including a cylinder block, a front end plate disposed on one end of said cylinder block, a rear end plate disposed on an opposite end of said cylinder block, said rear end plate having a discharge chamber and a suction chamber formed therein, said cylinder block having a plurality of cylinders formed therein, a crank chamber disposed forwardly of said plurality of cylinders and enclosed within said cylinder block by said front end plate, a piston slidably fitted within each of said cylinders, a piston chamber defined by each of said pistons and said cylinders, said pistons reciprocated by a drive mechanism, said drive mechanism including a drive shaft extending through an opening in said front end plate and rotatably supported therein, a drive rotor fixedly attached to and rotatable with said drive shaft, a slant plate attached to said drive rotor and disposed around said drive shaft and a wobble plate disposed on said slant plate and linked to said pistons through a connecting rod to reciprocate said pistons in said cylinders, said connecting rod including a ball portion formed at its one end, said piston including a spherical concavity formed at its bottom end to firmly receive said ball portion of said connecting rod while allowing said ball portion of said connecting rod to slidably move along an inner surface of said spherical concavity, at least one annular groove being provided on the outer peripheral surface of each of said pistons, at least one piston ring disposed within said at least one annular groove having an outer diameter larger than the outer diameter of said piston at normal temperatures, the improvement comprising:

means for throttling the piston chamber pressure, and means for lubricating said spherical concavity with said throttled piston chamber pressure, wherein said lubricating means comprises at least one conduit having said throttling means formed therein, one end of said conduit being open to a bottom surface of said at least one annular groove of each of said pistons and the other end of said conduit being open to the inner surface of said spherical concavity.

20. A method of supplying lubrication to a ball and socket joint in a piston and cylinder assembly of a refrigerant compressor including a suction chamber, crank chamber and discharge chamber comprising the steps of:

compressing a refrigerant, collecting lubricating oil from the cylinder during said compression, throttling said compressed refrigerant and lubricating oil to reduce the pressure of said compressed refrigerant and lubricating oil, and delivering said throttled refrigerant and lubricating oil to said ball and socket joint.

21. The method according to claim 20 wherein said throttling step comprises the step of flowing said compressed refrigerant and lubricating oil across a gap between a piston ring and the piston.

22. The method according to claim 21 wherein said delivering step comprises the step of conducting said throttled refrigerant and lubricating oil through a conduit to said ball and socket joint.

23. The method according to claim 20 further comprising the step of throttling said throttled refrigerant and lubricating oil through a gap between said ball and socket into said crank chamber.

24. The method according to claim 20 further comprising the step of throttling said throttled refrigerant and lubricating oil across a gap between another piston ring and the piston into said crank chamber.

25. In a refrigerant compressor including a compressor housing, said compressor housing including a cylinder block, a front end plate disposed on one end of said cylinder block, a rear end plate disposed on an opposite end of said cylinder block, said rear end plate having a discharge chamber and a suction chamber formed therein, said cylinder block having a plurality of cylinders formed therein, a crank chamber disposed forwardly of said plurality of cylinders and enclosed within said cylinder block by said front end plate, a piston slidably fitted within each of said cylinders, a piston chamber defined by each of said pistons and said cylinders, said pistons reciprocated by a drive mechanism, said drive mechanism including a drive shaft extending through an opening in said front end plate and rotatably supported therein, a drive rotor fixedly attached to and rotatable with said drive shaft, a slant plate attached to said drive rotor and disposed around said drive shaft and a wobble plate disposed on said slant plate and linked to said pistons through a connecting rod to reciprocate said pistons in said cylinders, said connecting rod including a ball portion formed at its one end, said piston including a spherical concavity formed at its bottom end to firmly receive said ball portion of said connecting rod while allowing said ball portion of said connecting rod to slidably move along an inner surface of said spherical concavity, at least one annular groove being provided on the outer peripheral surface of each of said pistons, at least one piston ring disposed within said at least one annular groove having an outer diameter larger than the outer diameter of said piston at normal temperatures, the improvement comprising:

means for throttling the piston chamber pressure, and means for lubricating said spherical concavity with said throttled piston chamber pressure, wherein said lubricating means comprises at least one conduit formed in each of said pistons, one end of said conduit being open to the outer peripheral surface of each of said pistons, said one end of said conduit disposed on the crank chamber side with respect to said at least one groove, and the other end of said conduit opening into said spherical concavity.

26. A method of supplying lubrication to a ball and socket joint in a piston and cylinder assembly of a refrigerant compressor including a suction chamber, crank chamber and discharge chamber, said method comprising the steps of:

compressing a refrigerant, collecting lubricating oil from the cylinder during said compression, throttling said compressed refrigerant and lubricating oil to reduce the pressure of said compressed refrigerant and lubricating oil, and delivering said throttled refrigerant and lubricating oil to said ball and socket joint, wherein said throttling step comprises the step of flowing said compressed refrigerant and lubricating oil through a small diameter portion of a conduit which is disposed in the piston.

* * * * *

UNITED STATES PATENT AND TRADEMARK OFFICE

CERTIFICATE OF CORRECTION

PATENT NO. : 5,137,431

DATED : August 11, 1992

INVENTOR(S) : Kiyoshi Terauchi et al.

It is certified that error appears in the above-identified patent and that said Letters Patent is hereby corrected as shown below:

On title page, item [19], delete "Kiyoshi" and insert --Terauchi--;

On title page, item [75], Inventors: delete "Terauchu Kiyoshi" and insert --Kiyoshi Terauchi-- and Column 3, line 63, delete "34" and insert --32--.

Signed and Sealed this

Twenty-sixth Day of October, 1993

*Attest:*

*Attesting Officer*

BRUCE LEHMAN

*Commissioner of Patents and Trademarks*